US006868579B2

(12) United States Patent
Yang

(10) Patent No.: US 6,868,579 B2
(45) Date of Patent: Mar. 22, 2005

(54) LOCKING DEVICE FOR EXHAUST FILTER COVER OF VACUUM CLEANER

(75) Inventor: Byung-Sun Yang, Changwon Gyeongnam (KR)

(73) Assignee: LG Electronics Inc., Seoul (KR)

( * ) Notice: Subject to any disclaimer, the term of this patent is extended or adjusted under 35 U.S.C. 154(b) by 366 days.

(21) Appl. No.: 10/151,159

(22) Filed: May 21, 2002

(65) Prior Publication Data

US 2003/0115714 A1 Jun. 26, 2003

(30) Foreign Application Priority Data

Dec. 20, 2001 (KR) ..... 2001-0082124

(51) Int. Cl.[7] ..... A47L 9/12

(52) U.S. Cl. ..... 15/347; 15/327.1; 15/327.7; 55/DIG. 3

(58) Field of Search ..... 15/347, 350–353, 15/327.1, 327.2, 327.6, 327.7; 55/DIG. 3, 359, 495, 511

(56) References Cited

U.S. PATENT DOCUMENTS 3,841,067 A * 10/1974 Kato et al. ..... 55/300
4,577,365 A * 3/1986 Yuen ..... 15/339
5,074,006 A * 12/1991 Eremita ..... 15/344
5,810,911 A * 9/1998 Behrendt et al. ..... 95/278
5,946,771 A * 9/1999 Bosyj et al. ..... 15/347
6,341,404 B1 * 1/2002 Salo et al. ..... 15/353
6,540,804 B1 * 4/2003 Wennerstrom ..... 55/472
2002/0162188 A1 * 11/2002 Harmen ..... 15/353
2002/0166200 A1 * 11/2002 Conrad et al. ..... 15/353

* cited by examiner

*Primary Examiner*—Terrence R. Till
(74) *Attorney, Agent, or Firm*—Fleshner & Kim, LLP

(57) ABSTRACT

The present invention relates to a locking structure for an exhaust filter cover of a vacuum cleaner. According to the present invention, there is provided a locking device for an exhaust filter cover of a vacuum cleaner, comprising locking protrusions formed to protrude radially inward from an inner end of the exhaust filter cover which includes a plurality of exhaust holes and supports a filter therein; and locking grooves within which the locking protrusions are locked and which are formed on an outer peripheral surface of an exhaust flange formed to protrude laterally from the circumference of a circular exhaust portion that is formed on a side surface of a motor housing fixed within a casing of a main body of the vacuum cleaner, whereby the exhaust filter cover is fixed to the main body of the vacuum cleaner. Furthermore, each locking groove includes an insertion portion formed linearly from the exterior to the interior, and a locking portion formed to be perpendicular to the insertion portion and to extend along the circumference of the exhaust flange.

4 Claims, 3 Drawing Sheets

LOCKING DEVICE FOR EXHAUST FILTER COVER OF VACUUM CLEANER

BACKGROUND OF THE INVENTION

1. Field of the Invention

The present invention relates to a vacuum cleaner, and more particularly, to a locking device for an exhaust filter cover of a vacuum cleaner, which is constructed such that the exhaust filter cover for supporting an exhaust filter on a main body of the vacuum cleaner can be strongly mounted on the main body of the vacuum cleaner.

2. Description of the Prior Art

As shown in FIG. 1, a main body 2 of a vacuum cleaner is formed on both side surfaces thereof with exhaust portions 4 through which air is exhausted. The exhaust portions serve to discharge, to the exterior of the vacuum cleaner, air resulting from removal of foreign substances from air containing the foreign substances introduced into the main body of the vacuum cleaner.

The exhaust portions 4 are formed by attaching both filters 4*b* and exhaust filter covers 4*a* to exhaust holes 6*a* formed on both side surfaces of a casing of the main body of the vacuum cleaner, which includes an upper casing 6 and a lower casing 8, as shown in FIG. 2.

Each exhaust filter cover 4*a* is fixed to the casing of the main body by fitting a protrusion 4*c* formed on an outer peripheral surface of the exhaust filter cover into the casing of the main body in which the exhaust holes 6*a* are formed. Here, each filter 4*b* serves to finally filter out the foreign substances, which may be contained in the exhausted air. The filter 4*b* is interposed between the exhaust filter cover 4*a* and the exhaust hole 6*a*, and then maintained between the exhaust filter cover 4*a* and the main body by means of mounting of the exhaust filter cover 4*a* on the main body.

According to such a conventional structure, it can be seen that the exhaust filter cover is mounted directly on the side surface of the main body of the vacuum cleaner. The main body of the vacuum cleaner moves during a cleaning operation. For example, if the vacuum cleaner is bumped to a wall during the movement, there may be a probability that the exhaust filter cover may escape from the main body of the vacuum cleaner. In addition, the conventional structure fails to provide a strong support structure for a portion where the exhaust filter cover is coupled to the main body of the vacuum cleaner.

According to the conventional constitution as described above, it can be seen that there is a disadvantage in that the exhaust filter cover coupled directly to the main body of the vacuum cleaner fails to provide a strong support structure.

SUMMARY OF THE INVENTION

The present invention is contemplated to solve the above problem in the prior art. A primary object of the present invention is to provide a locking device by which an exhaust filter cover can be more strongly supported on an outer surface of a main body of a vacuum cleaner.

According to one aspect of the present invention for accomplishing the above object, there is provided a locking device for an exhaust filter cover of a vacuum cleaner, comprising locking protrusions formed to protrude radially inward from an inner end of the exhaust filter cover which includes a plurality of exhaust holes and supports a filter therein; and locking grooves within which the locking protrusions are locked and which are formed on an outer peripheral surface of an exhaust flange formed to protrude laterally from the circumference of a circular exhaust portion that is formed on a side surface of a motor housing fixed within a casing of a main body of the vacuum cleaner, whereby the exhaust filter cover is fixed to the main body of the vacuum cleaner.

According to another aspect of the present invention, there is provided a locking device for an exhaust filter cover of a vacuum cleaner, comprising locking protrusions formed to protrude radially outward from an inner end of the exhaust filter cover which includes a plurality of exhaust holes and supports a filter therein; and locking grooves within which the locking protrusions are locked and which are formed on an inner peripheral surface of an exhaust flange formed to protrude laterally from the circumference of a circular exhaust portion that is formed on a side surface of a motor housing fixed within a casing of a main body of the vacuum cleaner, whereby the exhaust filter cover is fixed to the main body of the vacuum cleaner.

According to an embodiment of the present invention, each locking groove includes an insertion portion formed linearly from the exterior to the interior, and a locking portion formed to be perpendicular to the insertion portion and to extend along the circumference of the exhaust flange. Furthermore, according to another embodiment of the present invention, an inlet of the locking portion is formed with a catching boss to more strongly maintain the locked state of the locking protrusions which have been locked within the locking grooves.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Hereinafter, preferred embodiments of the present invention will be described in detail with reference to the accompanying drawings.

Figure 1:
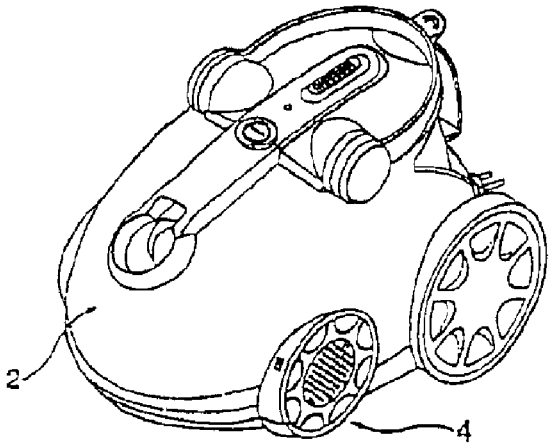
FIG.1 Conventional Art
FIG. 1 is a perspective view of a conventional vacuum cleaner.
Figure 2:
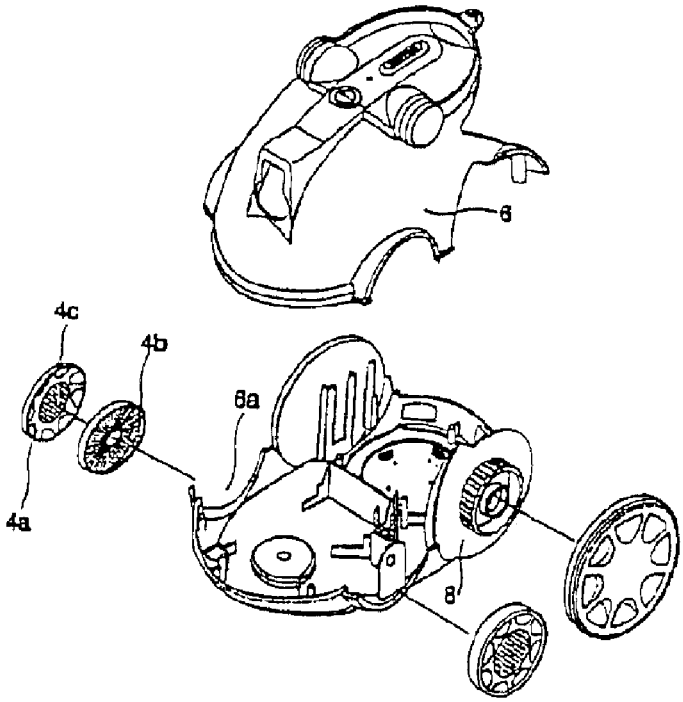
FIG. 2 Conventional Art
FIG. 2 is an exploded perspective view showing a structure of a conventional exhaust filter cover.
Figure 3A:
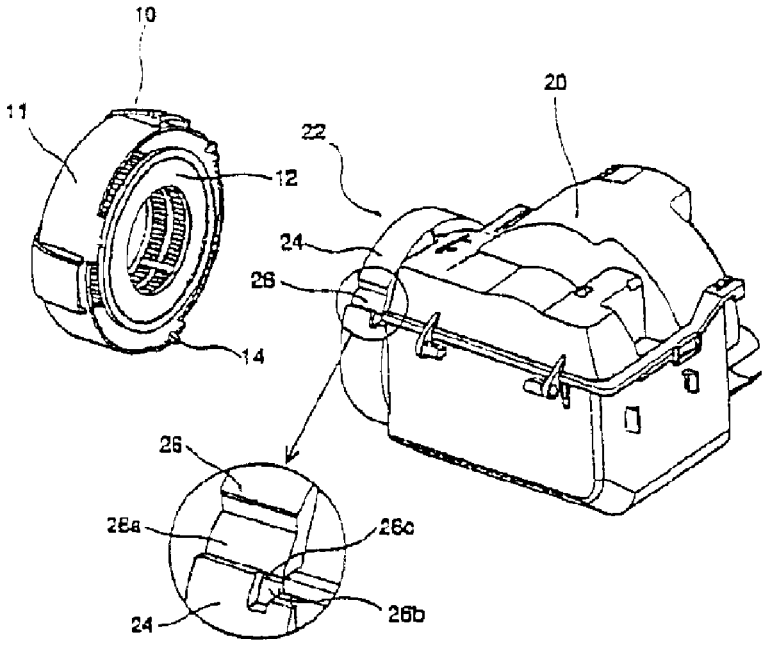
FIG. 3*a* is an exploded, partial perspective view showing the constitution of an exhaust filter cover according to one embodiment of the present invention.

As shown in FIG. 3*a*, an exhaust filter cover 10 according to the present invention takes the shape of a cylinder with a plurality of exhaust holes formed in an outer surface thereof. A circumferential surface 11 of the exhaust filter cover 10 is formed with a plurality of locking protrusions 14 protruding radially inward therefrom. A filter 12 for filtering out dust from exhausted air is installed within the exhaust filter cover 10.

The exhaust filter cover 10 is mounted on a motor housing 20 contained within a main body of a vacuum cleaner. According to the present invention, a stronger support structure can be provided by locking the exhaust filter cover 10 to the motor housing 20 fixed within a casing of the vacuum cleaner, as compared with the conventional structure. Moreover, air exhausted from the motor housing 20 can be more smoothly exhausted into the exhaust filter cover 10.

The motor housing 20 is formed, on one side surface thereof, with an exhaust portion 22 through which air that has passed the interior of the motor housing is exhausted, and the exhaust portion 22 is defined within an exhaust flange 24. The exhaust flange 24 is formed to protrude outwardly from the circumference of the circular exhaust portion 22 by a predetermined length.

The exhaust flange 24 is formed, on an outer peripheral surface, with locking grooves 26 within which the locking protrusions can be resiliently locked, respectively. As for the locking grooves 26, any locking grooves may be used as far as the locking protrusions can be resiliently locked and supported within the locking grooves, respectively.

Figure 3B:
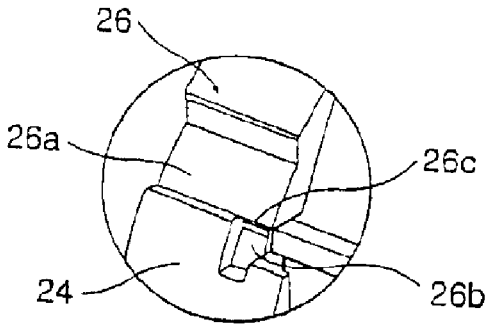
FIG. 3*b* is a magnified view showing the portion of the exhaust filer cover according to the embodiment of the present invention shown in FIG. 3*a;*

As shown in the magnified view of FIG. 3*b* of the illustrated embodiment, each locking groove 26 includes an insertion portion 26*a* recessed to allow the relevant locking protrusion to be fitted linearly from the exterior thereinto, and a locking portion 26*b* formed to extend circumferentially from and to be perpendicular to the insertion portion 26. That is, the respective locking grooves 26 are formed to take a ]-shape so that the locking protrusions 14 are inserted into the locking grooves and then completely locked within the locking grooves by means of subsequent rotation so as to more strongly maintain their locked state.

Figure 4:
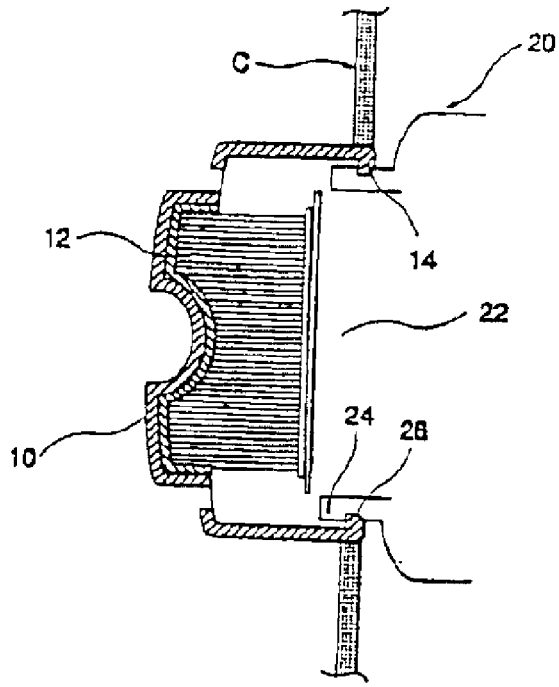
FIG. 4 is a sectional view showing an assembled state of the exhaust filter cover according to this embodiment of the present invention.

When the locking protrusions 14 are inserted into the locking grooves 26 in order to lock the exhaust filter cover 10 according to the present invention, the respective locking protrusions 14 are first inserted into the insertion portion 26*a* and then the exhaust filter cover 10 is rotated by a predetermined angle. By doing so, since the locking protrusions 14 are engaged to ends of the locking portions 26*b* so that their completely locked state can be maintained. Such a state is shown in a sectional view of FIG. 4. In FIG. 4, reference numeral C indicates the casing of the main body of the vacuum cleaner.

As shown in the figure, when the locking protrusions 14 are completely inserted into the locking portions 26*b*, accidental escape of the locking protrusions from the locking grooves can be prevented by the resilient force of synthetic resin material. However, in order to more securely prevent the accidental escape, it is preferable to form a convexly protruding catching boss 26*c* on an entrance of the locking portion 26*b*.

In the aforementioned embodiment, it can be seen that the locking protrusions 14 are formed to protrude inwardly from the circumferential surface of the exhaust filter cover 10 and the complementary locking grooves 26 are formed to be depressed on the outer peripheral surface of the exhaust flange 24 of the motor housing 20 so that the both can be engaged with each other.

Figure 5:
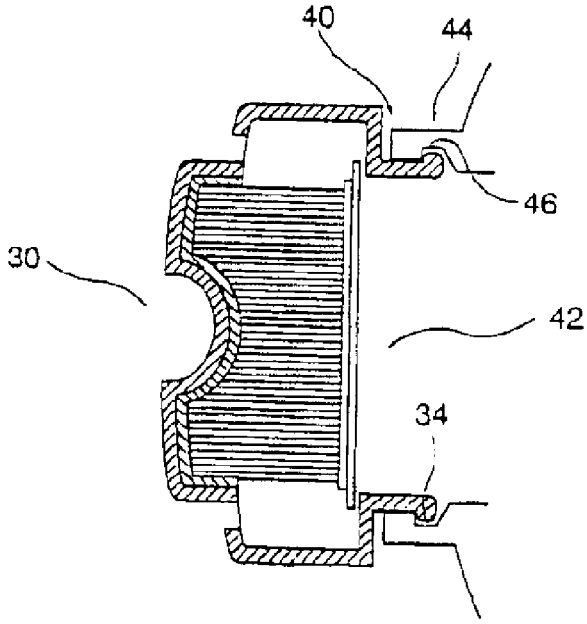
FIG. 5 is a sectional view showing an assembled state of an exhaust filter cover according to another embodiment of the present invention.

Next, another embodiment of the present invention shown in FIG. 5 will be described in detail. As shown in the figure, in this embodiment, an exhaust filter cover 30 is formed, on an inner end of a circumferential surface 41 thereof, with locking protrusions 34 which protrude radially outward. An exhaust flange 44 of an exhaust portion 42 of a motor housing 40 is formed, on an inner peripheral surface thereof, with locking grooves 46. In this embodiment, the locking protrusions 34 are resiliently locked within the locking grooves 46 so that an exhaust filter cover 30 can be resiliently locked to the motor housing 40.

In this embodiment, the respective locking grooves 46 may be constructed to take the same shape as the locking grooves of the aforementioned first embodiment.

As described above, it is a basic technical spirit of the present invention that the exhaust filter cover 10 within which the filter 12 is contained is securely locked to the exhaust portion 22 of the motor housing 20.

According to the aforementioned present invention, it can be understood that there is an advantage in that the exhaust filter cover within which the filter is contained can be securely locked directly to the motor housing and thus more strongly supported. Moreover, it can be expected to obtain an effect in that the exhaust filter cover is more strongly locked and supported when the respective locking grooves are constructed to take a ¬-shape.

It can be understood by the skilled in the art that various changes can be made thereto within the scope of the basic technical spirit of the present invention. The present invention should be construed based on the appended claims.

What is claimed is:

1. A locking device for an exhaust filter cover of a vacuum cleaner, comprising:

locking protrusions formed to protrude radially inward from an inner end of the exhaust filter cover which includes a plurality of exhaust holes and supports a filter therein; and locking grooves within which the locking protrusions are locked and which are formed on an outer peripheral surface of an exhaust flange formed to protrude laterally from the circumference of a circular exhaust portion that is formed on a side surface of a motor housing fixed within a casing of a main body of the vacuum cleaner, whereby the exhaust filter cover is fixed to the main body of the vacuum cleaner.

2. A locking device for an exhaust filter cover of a vacuum cleaner, comprising:

locking protrusions formed to protrude radially outward from an inner end of the exhaust filter cover which includes a plurality of exhaust holes and supports a filter therein; and locking grooves within which the locking protrusions are locked and which are formed on an inner peripheral surface of an exhaust flange formed to protrude laterally from the circumference of a circular exhaust portion that is formed on a side surface of a motor housing fixed within a casing of a main body of the vacuum cleaner, whereby the exhaust filter cover is fixed to the main body of the vacuum cleaner.

3. The locking device as claimed in claim 1, wherein each locking groove includes an insertion portion formed linearly from the exterior to the interior, and a locking portion formed to be perpendicular to the insertion portion and to extend along the circumference of the exhaust flange.

4. The locking device as claimed in claim 3, wherein an entrance of the locking portion is formed with a catching boss.

* * * * *